US007146967B2

(12) United States Patent
Hosoya

(10) Patent No.: US 7,146,967 B2
(45) Date of Patent: Dec. 12, 2006

(54) FUEL SUPPLY APPARATUS FOR ENGINE AND METHOD THEREOF

(75) Inventor: Hajime Hosoya, Isesaki (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/106,605

(22) Filed: Apr. 15, 2005

(65) Prior Publication Data

US 2005/0229906 A1 Oct. 20, 2005

(30) Foreign Application Priority Data

Apr. 16, 2004 (JP) ..... 2004-121065

(51) Int. Cl.
*F02M 37/04* (2006.01)
*F04B 17/00* (2006.01)
*F04B 49/00* (2006.01)

(52) U.S. Cl. ..... 123/497; 123/198 DB; 417/291; 417/326

(58) Field of Classification Search ..... 123/458, 123/497, 198 DB; 417/291, 326
See application file for complete search history.

(56) References Cited

U.S. PATENT DOCUMENTS

| | | | | |
|---|---|---|---|---|
| 2,107,152 | A * | 2/1938 | Huber | 418/14 |
| 2,781,726 | A * | 2/1957 | Bang | 418/39 |
| 4,488,452 | A * | 12/1984 | Jensen | 74/569 |
| 4,893,593 | A * | 1/1990 | Sejimo et al. | 123/179.9 |
| 5,245,819 | A * | 9/1993 | Kast | 60/734 |
| 6,076,507 | A * | 6/2000 | Blizard et al. | 123/467 |
| 6,536,217 | B1 * | 3/2003 | Lipinski et al. | 60/772 |
| 6,840,219 | B1 * | 1/2005 | Joos et al. | 123/456 |

FOREIGN PATENT DOCUMENTS

JP 11-247695 A 9/1999

* cited by examiner

*Primary Examiner*—Thomas Moulis
(74) *Attorney, Agent, or Firm*—Foley & Lardner LLP

(57) ABSTRACT

When a pressure of fuel supplied to an engine is higher than a target, the fuel is carried in a reverse direction by rotating a fuel pump in reverse, and in accordance therewith, the fuel pressure is made to fall with good responsiveness.

16 Claims, 2 Drawing Sheets

FUEL SUPPLY APPARATUS FOR ENGINE AND METHOD THEREOF

BACKGROUND OF THE INVENTION

1. Field of the Invention

The present invention relates to a technology of controlling a pressure of fuel supplied to an engine.

2. Description of the Related Art

There is described as a fuel supply apparatus which supplies fuel from a fuel tank to a fuel injection valve by a fuel pump as described in Japanese Unexamined Patent Publication No. 11-247695.

In the fuel supply apparatus, feedback control in which a target current is set in accordance with a target fuel pressure, and a driving current of the fuel pump is made to coincide with the target current is carried out.

By the way, in a conventional fuel supply apparatus, means for actively lowering a fuel pressure is not provided.

Therefore, for a request to lower a fuel pressure, there has been no means but to wait for that the fuel is removed from a fuel pipe due to the fuel injection from the fuel injection valve.

Accordingly, under the condition that a fuel injection quantity is little, such as a time when fuel injection is resumed from a state in which fuel is cut during deceleration state, or the like, it takes a long time that a fuel pressure higher than a target falls to the target.

Then, when a fuel pressure is higher than a target, in some cases, the combustibility deteriorates due to the injection characteristic from the fuel injection valve being varied. Further, when a fuel pressure is higher than a target, in some cases, a precision in measuring the fuel deteriorates, and the emission increases due to a fuel injection time being made short.

Here, when a route for returning fuel from the fuel pipe to the fuel tank is provided in order to actively lower a fuel pressure, there is the problem that the cost of the fuel supply apparatus rises.

SUMMARY OF THE INVENTION

Then, an object of the present invention is to avoid a deterioration in the combustibility and an increase in the emission due to a delay in lowering a fuel supply pressure by providing a fuel supply apparatus and a supply method which can actively lower a fuel supply pressure with a simple system.

In order to achieve the above-described object, in the present invention, a fuel pump is made to rotate in the reverse direction in response to a request for reduction in a fuel supply pressure.

The other objects and features of this invention will become understood from the following description with reference to the accompanying drawing.

PREFERRED EMBODIMENT

Figure 1:
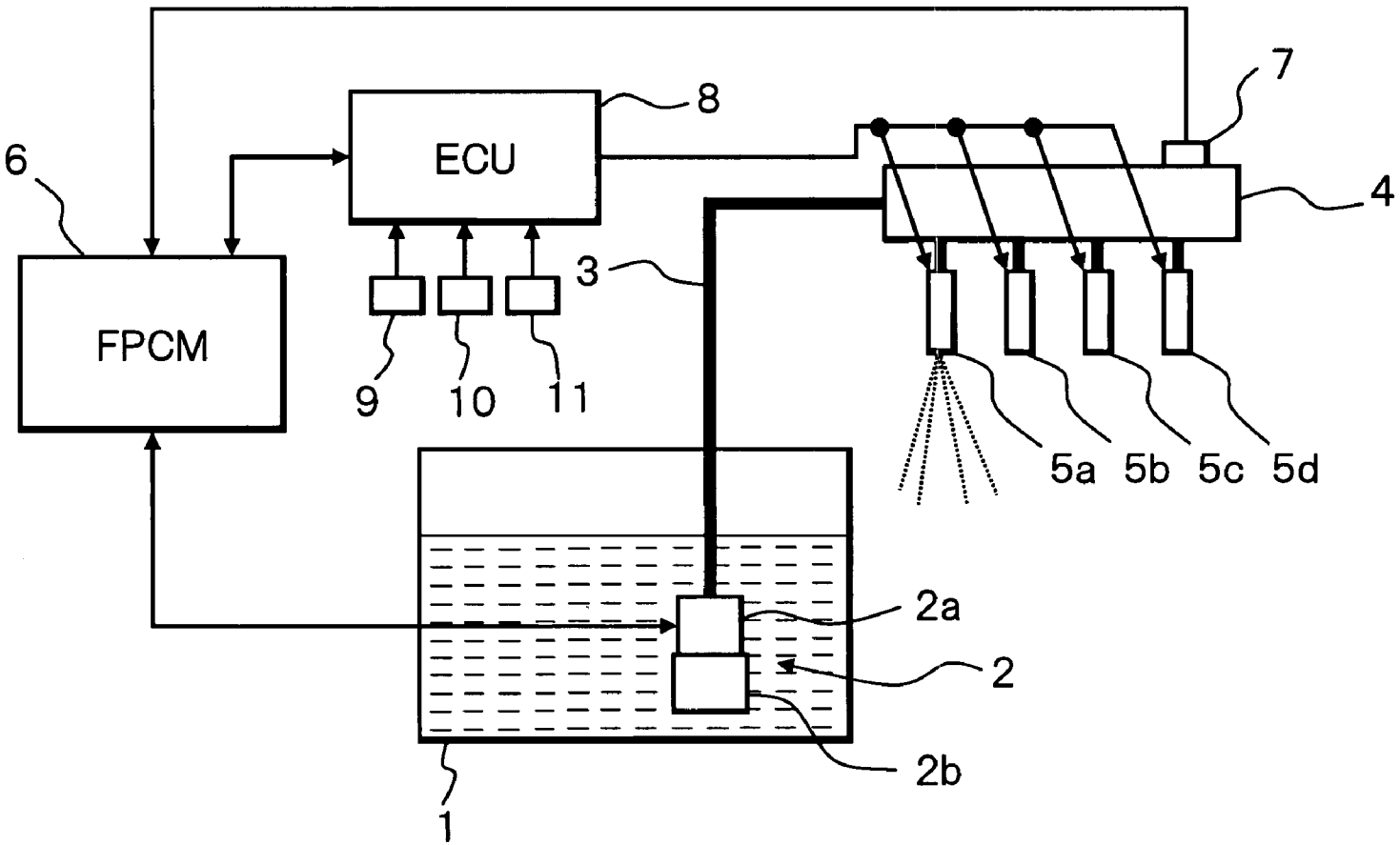
FIG. 1 is a system diagram showing a fuel supply apparatus in an embodiment of the present invention.

FIG. 1 is a system diagram showing a fuel supply apparatus in an embodiment of the present invention.

As shown in FIG. 1, a fuel pump 2 is built in a fuel tank 1.

Fuel pump 2 sucks and pressurizes fuel in fuel tank 1, and supplies the fuel to fuel injection valves 5*a* through 5*d* provided at each cylinder of an internal combustion engine (a gasoline engine) via a fuel pipe 3 and a fuel gallery 4.

Fuel injection valves 5*a* through 5*d* inject the fuel to intake ports of the respective cylinders or into the cylinders of the engine.

Fuel pump 2 includes a brushless motor 2*a* and a pump unit 2*b* driven by brushless motor 2*a*.

In the present embodiment, as will be described later, the rotational direction of fuel pump 2 is switched to a normal direction and a reverse direction. Here, due to brushless motor 2*a* being used as a power source, the reverse driving of fuel pump 2 can be easily realized, and further, the control of a discharge quantity of fuel pump 2 can be precisely carried out.

Brushless motor 2*a* is a motor in which the rotation thereof is controlled by carrying out an operation for successively switching a current direction of an electromagnetic coil in accordance with a position of a rotor detected by a Hall element.

However, a current sensor system or a sensorless type brushless motor can be employed in which a position of the rotor is detected by detecting a voltage or a current of each electromagnetic coil without using the Hall element.

Fuel injection valves 5*a* through 5*d* are intermittently opened by an injection pulse signal, and an injection quantity is controlled in accordance with the injection valve opening time.

Fuel pump 2 (brushless motor 2*a*) is controlled by a fuel pump control modulator (hereinafter, FPCM for short) 6.

Further, FPCM 6 and an engine control unit (hereinafter, ECU for short) 8 are structured so as to be able to communicate with one another.

An output signal of a fuel pressure sensor 7 detecting a fuel pressure in fuel gallery 4 is inputted to FPCM 6.

Then, FPCM 6 feedback-controls a rotational speed of fuel pump 2 (brushless motor 2*a*) such that the fuel pressure detected by fuel pressure sensor 7 is made to coincide with a target value transmitted from ECU 8.

Detection signals from an air flow meter 9 detecting an intake air quantity of the engine, a rotation sensor 10 detecting a rotational speed of the engine, a water temperature sensor 11 detecting a cooling water temperature of the engine, and the like are inputted to ECU 8.

Then, ECU 8 computes a fuel injection quantity on the basis of the detection signals, and controls fuel injection valves 5*a* through 5*d* on the basis of the fuel injection quantity. Further, ECU 8 computes a target fuel pressure, and transmits the data of the target fuel pressure to FPCM 6.

FPCM 6 controls the rotation of brushless motor 2*a* by carrying out control in which a position of the rotor of brushless motor 2*a* is detected on the basis of an output voltage of the Hall element, and the current direction of the electromagnetic coil is successively switched on the basis of the position of the rotor.

In the present embodiment, FPCM 6 switches the rotational direction of brushless motor 2*a* to a normal direction and a reverse direction. The normal direction is a direction in which fuel pump 2 sucks fuel from fuel tank 1 and discharges the fuel to fuel pipe 3, and the reverse direction is a direction in which fuel pump 2 sucks fuel from fuel pipe 3 and discharges the fuel to fuel tank 1.

Figure 2:
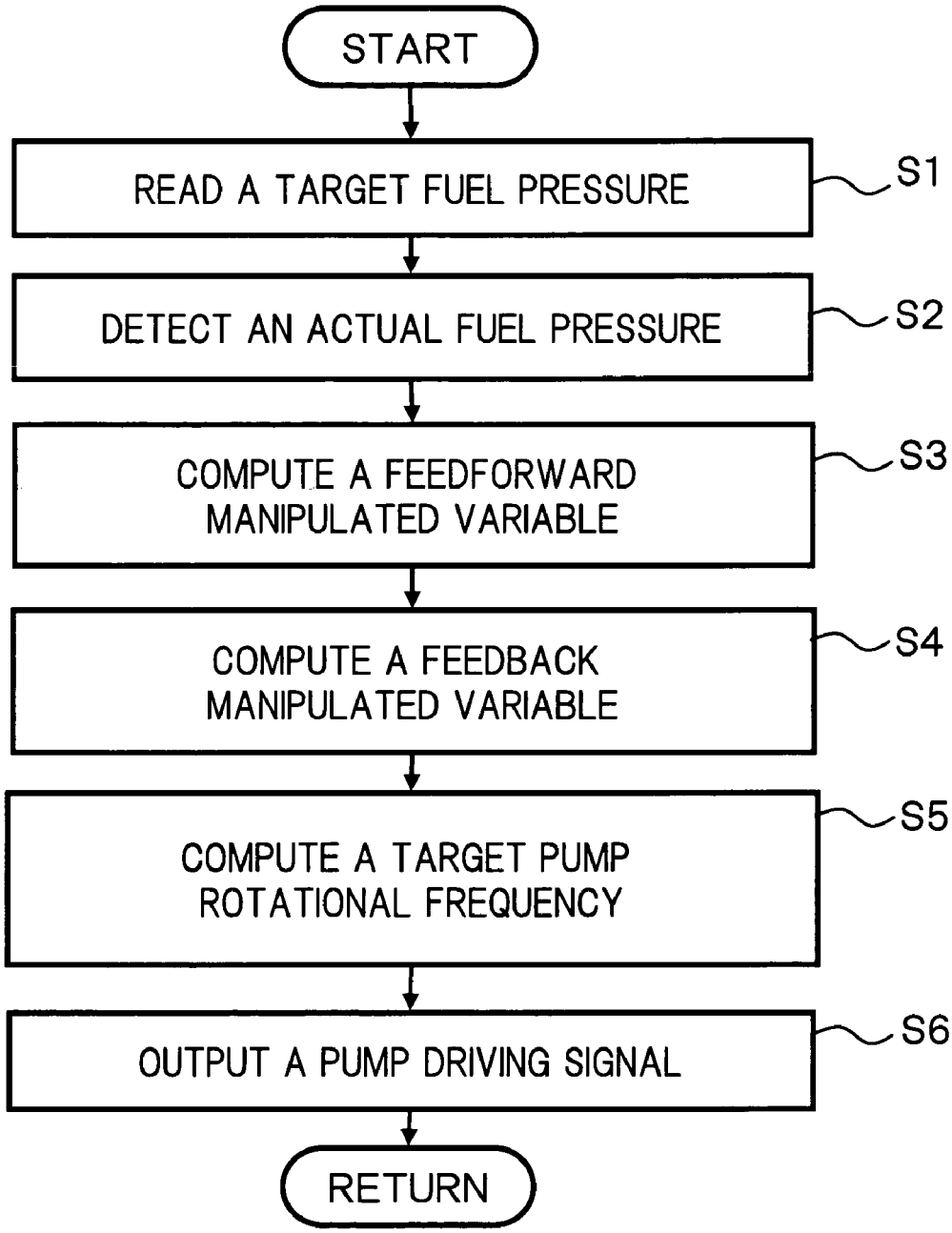
FIG. 2 is a flowchart showing the control of a fuel pump in the embodiment of the present invention.

FPCM 6 feedback-controls the rotation of fuel pump 2 (brushless motor 2*a* ) as shown in the flowchart of FIG. 2.

At step S1, a signal of a target fuel pressure transmitted from ECU 8 is read.

At step S2, an actual fuel pressure is detected on the basis of a detection signal from fuel pressure sensor 7.

At step S3, a outgo of the fuel quantity in fuel pipe 3 and fuel gallery 4 is computed on the basis of signals of engine operating conditions (a fuel injection quantity signal, and engine rotational speed signal, and the like) transmitted from ECU 8. Then, a feed-forward manipulated variable of fuel pump 2 is computed on the basis of the outgo of the fuel quantity.

The outgo of the fuel quantity is a fuel quantity supplied from fuel pipe 3 and fuel gallery 4 to the engine per unit time.

Note that the feed-forward manipulated variable is a manipulated variable for compensating a fuel quantity consumed at the engine, and is computed always as a plus value.

As described above, when there is no variation in the target fuel pressure, and an actual fuel pressure is close to the target, the fuel supply pressure is maintained to be close to the target by controlling fuel pump 2 by the feed-forward manipulated variable.

At step S4, a deviation between the target fuel pressure read at step S1 and the fuel pressure detected at step S2 is computed. Then, a feedback manipulated variable is computed by a proportional control action/an integral control action/a derivative control action which are based on the deviation.

Here, the deviation between the target fuel pressure and an actual fuel pressure is computed as a signed value. Namely, when an actual fuel pressure is lower than the target, the deviation is computed so as to be a plus value, and when an actual fuel pressure is higher than the target, the deviation is computed so as to be a minus value.

Moreover, the feedback manipulated variable is computed as a signed value.

Here, a plus manipulated variable is a manipulated variable for rotating fuel pump 2 in the normal direction, and a minus manipulated variable is a manipulated variable for rotating fuel pump 2 in the reverse direction.

Namely, when an actual fuel pressure is higher than the target, the fuel is removed from fuel pipe 3 and fuel gallery 4 by the carrying capacity of fuel pump 2 due to fuel pump 2 being rotated in the reverse direction.

Accordingly, the state in which an actual fuel pressure is higher than the target can be rapidly canceled, and it is suppressed that the combustibility deteriorates and the emission increases due to an actual fuel pressure being higher than the target.

At step S5, the sum of the feed-forward manipulated variable and the feedback manipulated variable is computed as a signed value. Then, a target pump rotational speed (rpm) is computed as a signed value indicating a rotational direction on the basis of the sum of the feed-forward manipulated variable and the feedback manipulated variable.

Even when an actual fuel pressure is higher than the target, and the feedback manipulated variable is computed as a minus value, in a case in which a feed-forward manipulated variable greater than the absolute value of the feedback manipulated variable is computed, the sum of the feed-forward manipulated variable and the feedback manipulated variable is made to be a plus value, and fuel pump 2 is driven in the normal direction.

Accordingly, when a fuel pressure cannot be made to fall with good responsiveness by only the fuel quantity injected by fuel injection valves 5*a* through 5*d*, fuel pump 2 is driven in the reverse direction.

On the other hand, when an actual fuel pressure is lower than the target, it is controlled such that the sum of a quantity to be refilled into the fuel pipe by a quantity injected by fuel injection valves 5*a* through 5*d* and a quantity to be supplied into the fuel pipe in order to raise the fuel supply pressure is discharged from fuel pump 2.

At step S5 described above, when the sum of the feed-forward manipulated variable and the feedback manipulated variable is plus, it is judged as a request to rotate fuel pump 2 in the normal direction, and the target pump rotational speed (rpm) is computed as a plus value. Further, when the sum of the feed-forward manipulated variable and the feedback manipulated variable is minus, it is judged as a request to rotate fuel pump 2 in the reverse direction, and the target pump rotational speed (rpm) is computed as a minus value.

At step S6, it is judged whether fuel pump 2 (brushless motor 2*a* ) is driven in the normal direction or driven in the reverse direction by judging whether the target pump rotational speed (rpm) is plus or minus. Further, a driving signal corresponding to the target pump rotational speed (rpm) and a requested rotational direction is outputted to brushless motor 2*a*.

Note that a feedback gain at the time of computing a feedback manipulated variable in accordance with a difference between the fuel carrying capacities based on the positive rotation and the reverse rotation of fuel pump 2 can be switched in accordance with whether the deviation is plus or minus.

Further, the dead zone width of the feedback control can be made different in the plus side and in the minus side of the deviation.

Moreover, fuel pump 2 can be reversed in advance by predicting an occurrence of a request for reduction in a pressure.

By the way, provided that a fuel pump in which back flow is brought about by a back pressure is used, the fuel can be made to flow backward by stopping the fuel pump when there is a request for reduction in a pressure, and the fuel pressure can be made to fall.

Further, provided that a structure is used in which the suction and discharge directions can be reversed while maintaining to rotate the fuel pump in the normal direction, a fuel pressure can be made to fall with good responsiveness when there is a request for reduction in a pressure.

However, when a fuel pump in which back flow is brought about by a back pressure is used, it is difficult to precisely control a quantity of reducing pressure. Further, in the structure that the suction and discharge directions are reversed, the structure of the fuel supply apparatus is made complicated.

In contrast thereto, as in the present embodiment described above, provided that fuel pump 2 is reversed in response to a request for reduction in a pressure, a fuel pressure can be made to fall with good responsiveness without changing any pipe or adding any valve, and moreover, a quantity of reducing pressure can be precisely controlled.

The entire contents of Japanese Patent Application NO.2004-121065, filed Apr. 16, 2004 are incorporated herein by reference.

While only selected embodiments have been chosen to illustrate the present invention, it will be apparent to those skilled in the art from this disclosure that various change and modification can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

I claim:

1. A fuel supply apparatus for an engine comprising:

a fuel tank;

a fuel pump which supplies fuel from said fuel tank to said engine;

a control device which switches a rotational direction of said fuel pump to a normal direction and a reverse direction; and a judging device which judges whether or not there is a request for reduction in a fuel supply pressure, wherein said control device rotates said fuel pump in the reverse direction when a request for reduction in said fuel supply pressure is generated, and wherein said judging device inputs a target value of said fuel supply pressure and a detected value of said fuel supply pressure, and judges whether or not there is a request for reduction in said fuel supply pressure on the basis of a deviation between said target value and said detected value.

2. A fuel supply apparatus for an engine according to claim 1, wherein said judging device computes a deviation between said target value and said detected value as a signed value, and judges whether or not there is a request for reduction in said fuel supply pressure on the basis of a sign of said deviation.

3. A fuel supply apparatus for an engine according to claim 2, wherein said control device computes a manipulated variable for rotating said fuel pump in the normal direction and a manipulated variable for rotating said fuel pump in the reverse direction so as to discriminate between those by signs.

4. A fuel supply apparatus for an engine according to claim 3, wherein said control device computes, as a signed value, a feedback manipulated variable of said fuel pump, which is for making said detected value coincide with said target value, on the basis of said signed deviation.

5. A fuel supply apparatus for an engine according to claim 4, wherein said control device switches a feedback gain at a time of being requested to rotate said fuel pump in the normal direction, and at a time of being requested to rotate said fuel pump in the reverse direction.

6. A fuel supply apparatus for an engine according to claim 4, wherein said control device switches a width of a dead zone of said feedback control at a time of being requested to rotate said fuel pump in the normal direction, and at a time of being requested to rotate said fuel pump in the reverse direction.

7. A fuel supply apparatus for an engine according to claim 4, wherein said control device computes a fuel quantity supplied to the engine per unit time, computes a feed-forward manipulated variable on the basis of said fuel quantity, and controls said fuel pump on the basis of an additional value of said feedback manipulated variable and said feed-forward manipulated variable, and a sign thereof.

8. A fuel supply apparatus for an engine comprising:

a fuel tank;

a fuel pump which supplies fuel from said fuel tank to said engine; and a control device which switches a rotational direction of said fuel pump to a normal direction and a reverse direction, wherein said fuel pump is driven by a brushless motor.

9. A fuel supply apparatus for an engine comprising:

a fuel tank;

a fuel pump which supplies fuel from said fuel tank to said engine;

control means for switching a rotational direction of said fuel pump to a normal direction and a reverse; and judging means which judges whether or not there is a request for reduction in a fuel supply pressure, wherein said control means rotates said fuel pump in the reverse direction when a request for reduction in said fuel supply pressure is generated, and wherein said judging means inputs a target value of said fuel supply pressure and a detected value of said fuel supply pressure, and judges whether or not there is a request for reduction in said fuel supply pressure on the basis of a deviation between said target value and said detected value.

10. A fuel supply method for an engine which has a fuel tank and a fuel pump which supplies fuel from said fuel tank to the engine, comprising the steps of:

judging whether or not there is a request for reduction in a fuel supply pressure, by:

inputting a target value of said fuel supply pressure and a detected value of said fuel supply pressure:

computing a deviation between said target value and said detected value; and judging whether or not there is a request for reduction in said fuel supply pressure on the basis of said; and rotating said fuel pump in the reverse direction when a request for reduction in said fuel supply pressure is generated.

11. A fuel supply method for an engine which has a fuel tank and a fuel pump which supplies fuel from said fuel tank to the engine, comprising the steps of:

judging whether or not there is a request for reduction in a fuel supply pressure by:

inputting a target value of said fuel supply pressure and a detected value of said fuel supply pressure:

computing a deviation between said target value and said detected value as a signed value; and judging whether or not there is a request for reduction in said fuel supply pressure on the basis of the signed value of said; and rotating said fuel pump in the reverse direction when a request for reduction in said fuel supply pressure is generated.

12. A fuel supply method for an engine according to claim 11, wherein the step of rotating said fuel pump in the reverse direction comprises the step of:

computing a manipulated variable for rotating said fuel pump in the normal direction and a manipulated variable for rotating said fuel pump in the reverse direction so as to discriminate between those by signs.

13. A fuel supply method for an engine according to claim 12, wherein the step of rotating said fuel pump in the reverse direction comprises the step of:

computing, as a signed value, a feedback manipulated variable of said fuel pump, which is for making said detected value coincide with said target value, on the basis of said signed deviation.

14. A fuel supply method for an engine according to claim 13, further comprising the following step of:

switching a feedback gain at a time of being requested to rotate said fuel pump in the normal direction, and at a time of being requested to rotate said fuel pump in the reverse direction.

15. A fuel supply method for an engine according to claim 13, further comprising the following step of:

switching a width of a dead zone of said feedback control at a time of being requested to rotate said fuel pump in the normal direction, and at a time of being requested to rotate said fuel pump in the reverse direction by said control device.

16. A fuel supply method for an engine according to claim 13, wherein the step of rotating said fuel pump in the reverse direction comprises the steps of:

computing a fuel quantity supplied to the engine per unit time, computing a feed-forward manipulated variable on the basis of said fuel quantity, and controlling said fuel pump on the basis of an additional value of said feedback manipulated variable and said feed-forward manipulated variable, and a sign thereof.

* * * * *